US006549168B1

(12) United States Patent
Ryken et al.

(10) Patent No.: US 6,549,168 B1
(45) Date of Patent: Apr. 15, 2003

(54) GPS AND TELEMETRY MICROSTRIP ANTENNA FOR USE ON PROJECTILES

(75) Inventors: Marvin L. Ryken, Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/107,343

(22) Filed: Mar. 28, 2002

Related U.S. Application Data

(63) Continuation-in-part of application No. 10/039,939, filed on Oct. 19, 2001, now Pat. No. 6,466,172.

(51) Int. Cl.[7] ..... H01Q 1/36

(52) U.S. Cl. ..... 343/700 MS; 343/705; 343/846

(58) Field of Search ..... 343/700 MS, 725, 343/705, 708, 829, 846, 853; 333/134; 342/354, 371; H01Q 1/36

(56) References Cited

U.S. PATENT DOCUMENTS

| | | | | | |
|---|---|---|---|---|---|
| 3,683,281 | A | * | 8/1972 | Watts | 325/312 |
| 4,074,270 | A | * | 2/1978 | Kaloi | 343/700 MS |
| 4,736,454 | A | * | 4/1988 | Hirsch | 455/129 |
| 5,019,829 | A | * | 5/1991 | Heckman et al. | 343/700 MS |
| 5,455,594 | A | * | 10/1995 | Blasing et al. | 343/700 MS |
| 6,011,518 | A | * | 1/2000 | Yamagishi et al. | 343/713 |
| 6,466,172 | B1 | * | 10/2002 | Ryken et al. | 343/700 MS |

* cited by examiner

*Primary Examiner*—Tho Phan
(74) *Attorney, Agent, or Firm*—David Kalmbaugh

(57) ABSTRACT

A microstrip antenna system having a GPS antenna for receiving GPS data and a telemetry antenna for transmitting telemetry data mounted on a dielectric substrate. The microstrip antenna system is designed for use on small diameter airborne projectiles which have a diameter of about 2.75 inches. A pair of band stop filters are integrated into the antenna system to isolate the transmitted telemetry signal from the received GPS signal.

20 Claims, 6 Drawing Sheets

GPS AND TELEMETRY MICROSTRIP ANTENNA FOR USE ON PROJECTILES

This application is a continuation-in-part of U.S. patent application, Ser. No. 10/039,939, filed Oct. 19, 2001 now U.S. Pat. No. 6,466,172.

BACKGROUND OF THE INVENTION

1. Field of the Invention

The present invention relates generally to an antenna for use on a missile or the like. More specifically, the present invention relates to a microstrip antenna which includes a GPS antenna for receiving GPS data and a telemetry antenna for transmitting telemetry data and which is adapted for use on small diameter devices such as a missile.

2. Description of the Prior Art

In the past military aircraft and weapons systems such as airplanes, target drones, pods and missiles have included flight termination and beacon tracking antenna to monitor performance during test flights. For example, a missile under test will always have an antenna which is generally surface mounted to transmit telemetry data to a ground station. The ground station then performs an analysis of the telemetry data from the missile to determine its performance during flight while tracking a target.

U.S. Pat. No. 4,356,492 is an example of a prior art microstrip antenna which is adapted for use on a missile as a wrap around band to a missile body without interfering with the aerodynamic design of the missile. U.S. Pat. No. 4,356,492 teaches a plurality of separate radiating elements which operate at widely separated frequencies from a single common input point. The common input point is fed at all the desired frequencies from a single transmission feed line.

With the emerging use of the Global Positioning System (GPS) for tracking purposes, there is a need to include GPS within the instrumentation package for a missile and target drone to accurately measure flight performance. GPS data is extremely accurate and thus allows for a thorough analysis of the missile's performance as well as the target drone's performance in flight while the missile tracks the target drone on a course to intercept the target drone.

The use of satellite provided GPS data to monitor the position of a missile and a drone target in flight will require that an antenna for receiving the GPS data be included in the instrumentation package. The receiving antenna should preferably be mounted on the same dielectric substrate as the transmitting antenna so that the antenna assembly can be applied readily as a wrap around band to the missile body without interfering with the aerodynamic design of the missile. Similarly, the antenna assembly which would include a GPS data receiving antenna and telemetry data transmitting antenna configured as a wrap around band to the projectile's body without interfering with the aerodynamic design of the projectile.

SUMMARY OF THE INVENTION

The present invention overcomes some of the disadvantages of the past including those mentioned above in that it comprises a relatively simple in design yet highly effective and efficient microstrip antenna assembly which can receive satellite provided GPS position and also transmit telemetry data. The microstrip antenna comprising the present invention is configured to wrap around the projectile's body without interfering with the aerodynamic design of the projectile.

The antenna assembly of the present invention includes a first microstrip antenna which is a telemetry antenna mounted on a dielectric substrate. The telemetry antenna transmits telemetry data to ground station or other receiving station. There is also a second microstrip antenna mounted on the dielectric substrate which is physically separated from the first microstrip antenna on the dielectric substrate. The second microstrip antenna is a GPS antenna adapted to receive satellite provided GPS position data. The antenna assembly is a wrap around antenna assembly which fits on the outer surface of a missile, target drone or any other small diameter projectile.

The telemetry antenna includes a pair of radiating elements with one radiating element being positioned on one side of the projectile and the other element being positioned on the opposite side of the projectile. One of the two radiating elements of the telemetry antenna has a feed line which provides for a 180 degree phase shift of the transmitted RF signal relative to the feed line for the other radiating element. This phase shift insures that the electric field for the transmitted RF signal is continuous around the circumference of the projectile.

The GPS antenna also has a pair of microstrip receiving antenna elements which are circularly polarized. Due to the close proximity of the telemetry and GPS antennas each antenna includes a band stop filter which are integrated into the GPS and telemetry antennas. The band stop filters have a minimum stop-band rejection of 50 decibels to prevent the telemetry data signal from saturating the GPS antenna.

DETAILED DESCRIPTION OF THE PREFERRED EMBODIMENT

Figure 1:
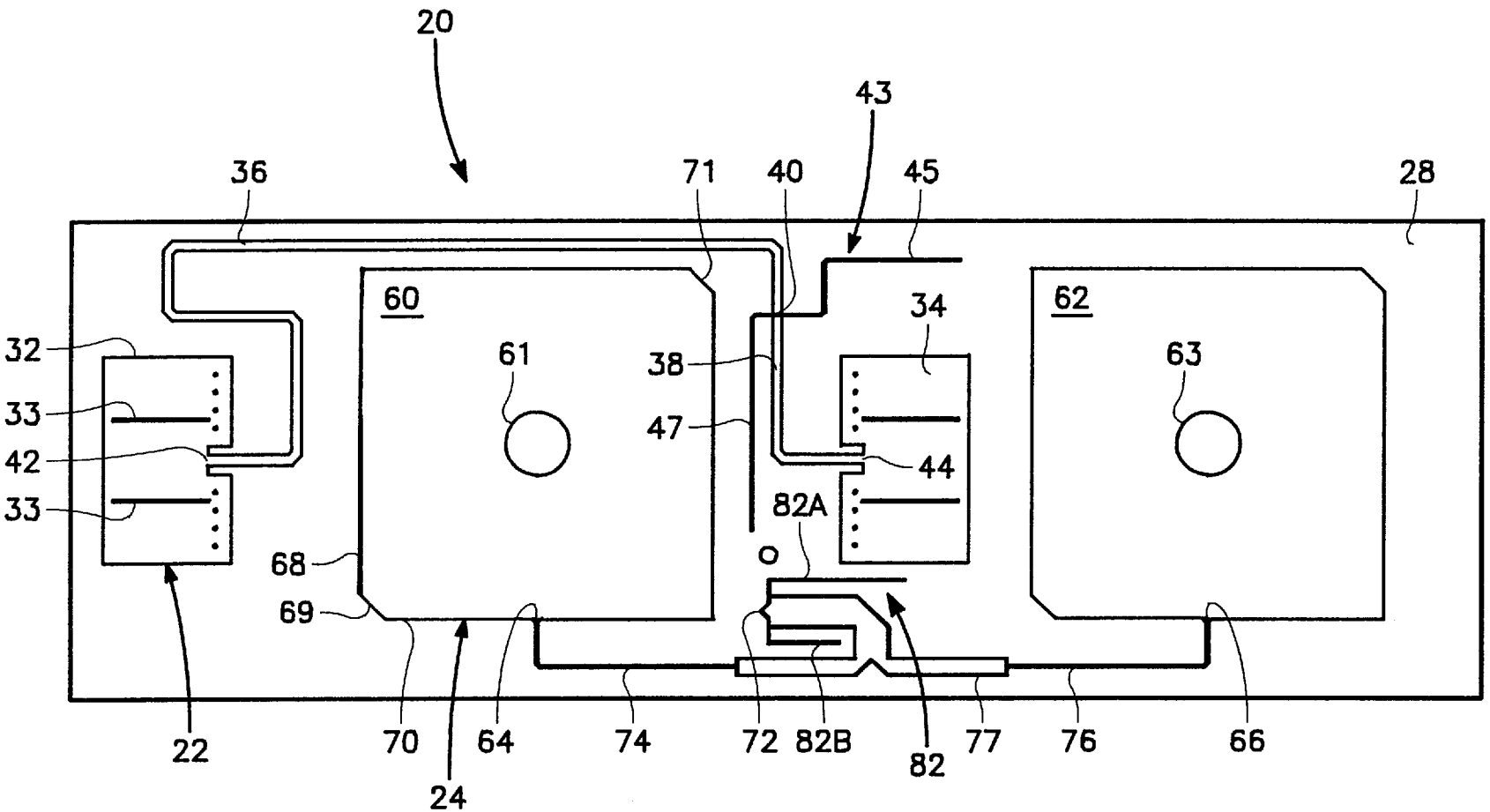
FIG. 1 is a plan view of a preferred embodiment of the present invention comprising a GPS and telemetry microstrip antenna mounted on a dielectric substrate.

Referring first to FIGS. 1, 2, 3 and 4, there is shown a microstrip antenna assembly 20 comprising a telemetry antenna 22 and a GPS (Global Positioning System) antenna 24 for use on small diameter projectiles such as missiles and target drones. The diameter of the projectile 26 for which antenna assembly 20 is designed is approximately 2.75 inches.

The telemetry antenna 22 and GPS antenna 24 are separated physically and are mounted on a dielectric substrate 28. Positioned below dielectric substrate 28 is a ground plane (not shown in FIG. 1). Dielectric substrate 28 may be fabricated from a laminate material RT/Duroid 6002 commercially available from Rogers Corporation of Rogers Conn. This material allows sufficient strength and physical and electrical stability to satisfy environmental requirements and is also easily mounted on the surface of a missile or a target drone. The dielectric substrate 28 may be fabricated from two layers of 0.031 inch thick material, and a 0.010 inch thick antenna protective cover board. The use of the multi-layer fabrication to fabricate the substrate is to prevent wrinkling and cracking of the substrate when the dielectric 28 is mounted on the surface of the missile 130 (as depicted in FIGS. 5 and 6).

The telemetry antenna 22 comprises two separate microstrip radiating elements/antenna transmitting elements 32 and 34 respectively fed by microstrip feed lines 36 and 38 from a single feed input point 40 as shown in FIG. 1. The radiating elements 32 and 34 each have a shape which is rectangular and are notch fed. The element feed point 42 for radiating element 32 comprises a 100 ohm input and the element feed point 44 for radiating element 34 also comprises a 100 ohm input. The single feed input point 40 for both radiating elements 32 and 34 comprises a 50 ohm feed input. Paralleling the feed lines 36 and 38 which are 100 ohm transmission lines produces the input impedance of 50 ohms.

At this time it should be noted that the corporate feed line comprising feed lines 36 and 38 combine radiating elements 32 and 34 with equal amplitude and equal phase to maintain a match to the input 50 ohm line 40. The corporate feed line is 100 ohms characteristic impedance so that a 50 ohm input to the line will see a 50 ohm match because the two 100 ohm lines are in parallel.

The electric field generated by the RF signal transmitted by radiating elements 32 and 34 of telemetry antenna 22 needs to be continuous around the circumference of projectile 26. This, in turn, necessitates that one of the microstrip feed lines 36 or 38 provide for a 180 degree phase shift relative to the other feed line over the operating frequency range for telemetry antenna 22.

The phase is matched by reversing one radiating element relative to the other radiating element to achieve a 180 degree phase difference between the two radiating elements of the telemetry antenna 22. Phase compensation is accomplished by adding an additional one half wavelength plus an additional wavelength to antenna transmitting element 32. The difference between the length of microstrip feed line 36 and the length of the feed line 38 adds the one half wavelength plus the additional wavelength to antenna transmitting element 32.

There are two additional lines 45 and 47 included in the telemetry antenna 22. Lines 45 and 47 are electrically connected to input 40 of telemetry antenna 22. Lines 45 and 47 are open circuit transmission lines and form components of a filter 43. Filtering is required to reduce the induced signal from the TM transmitter 22 at the GPS frequency bandwidth. Filter 43 operates as a band stop filter at the GPS frequency range which is approximately 2.25–2.29 GHz. The open circuit lines 45 and 47 are tuned so that when the lines 45 and 47 resonate at a quarter wavelength, the open circuit translates to a short circuit.

Each radiating element 32 and 34 of telemetry antenna 22 includes a pair of elongated slots 33 which are mode suppression slots.

The GPS receiving antenna 24 is also mounted on the dielectric substrate 28 in proximity to the telemetry antenna 22. The GPS receiving antenna 24 comprises two separate microstrip antenna receiving elements 60 and 62 which respectively have feed points 64 and 66 a shown in FIG. 1. Since antenna receiving elements 60 and 62 are required to be circularly polarized, opposed corners 69 and 71 of each element 60 and 62 are angled at approximately forty-five degrees. This results in truncated corner patches which allow for excitation of the elements 60 and 62 along their orthogonal axis. The sides 68 and 70 of each element 60 and 62 have identical lengths.

Receiving element 60 and receiving element 62 respectively have centrally located apertures 61 and 63 in their etched copper patches. The apertures 61 and 63 allow receiving elements 60 and 62 to operate effectively while reducing the size of each element 60 and 62.

The corporate feed for GPS (Global Positioning System) antenna 24, which comprises microstrip feed lines 74 and 76, combine receiving elements 60 and 62 with equal amplitude and equal phase to maintain a match to the input 50 ohm line 72. Antenna 24 includes a matching power divider identified by the reference numeral 77. The power divider 77 includes two lines 82A and 82B. Lines 82A and 82B are open circuit transmission lines which form part of a filter 82 at the TM frequency range.

Filtering is required to reduce the induced signal from the TM transmitting antenna 22 and any other signals that are present at the TM frequency bandwidth. Open circuited line 82A and 82B are tuned so that when the lines 82A and 82B resonate at a quarter wavelength at approximately 2.25 GHz., the open circuit translates to a short circuit at power divider 77. Filter 82 operates as a band stop filter at the TM frequency range.

Band stop filter 82 has a minimum stop-band rejection of 50 decibels. Band stop filter 78, which is integrated into GPS antenna 24, isolates the transmitted telemetry signal from the received GPS signal. There is a need for band stop filter 78 because of the close proximity of antenna 22 to antenna 24.

GPS antenna 24 has the following electrical characteristics: (1) a center frequency of 1572.5 MHz which is an L-Band Radio Frequency (GPS Band L1); (2) a bandwidth of ±10 MHz (3) a circular polarization; and (4) a roll coverage of −3 db+/−5 db.

Telemetry antenna 22 has the following electrical characteristics: (1) a center frequency of 2250 MHz which is an S-Band Radio Frequency; (2) a bandwidth of ±10 MHz (3) a linear polarization; and (4) a roll coverage of −3 db+/−5 db.

Figure 2:
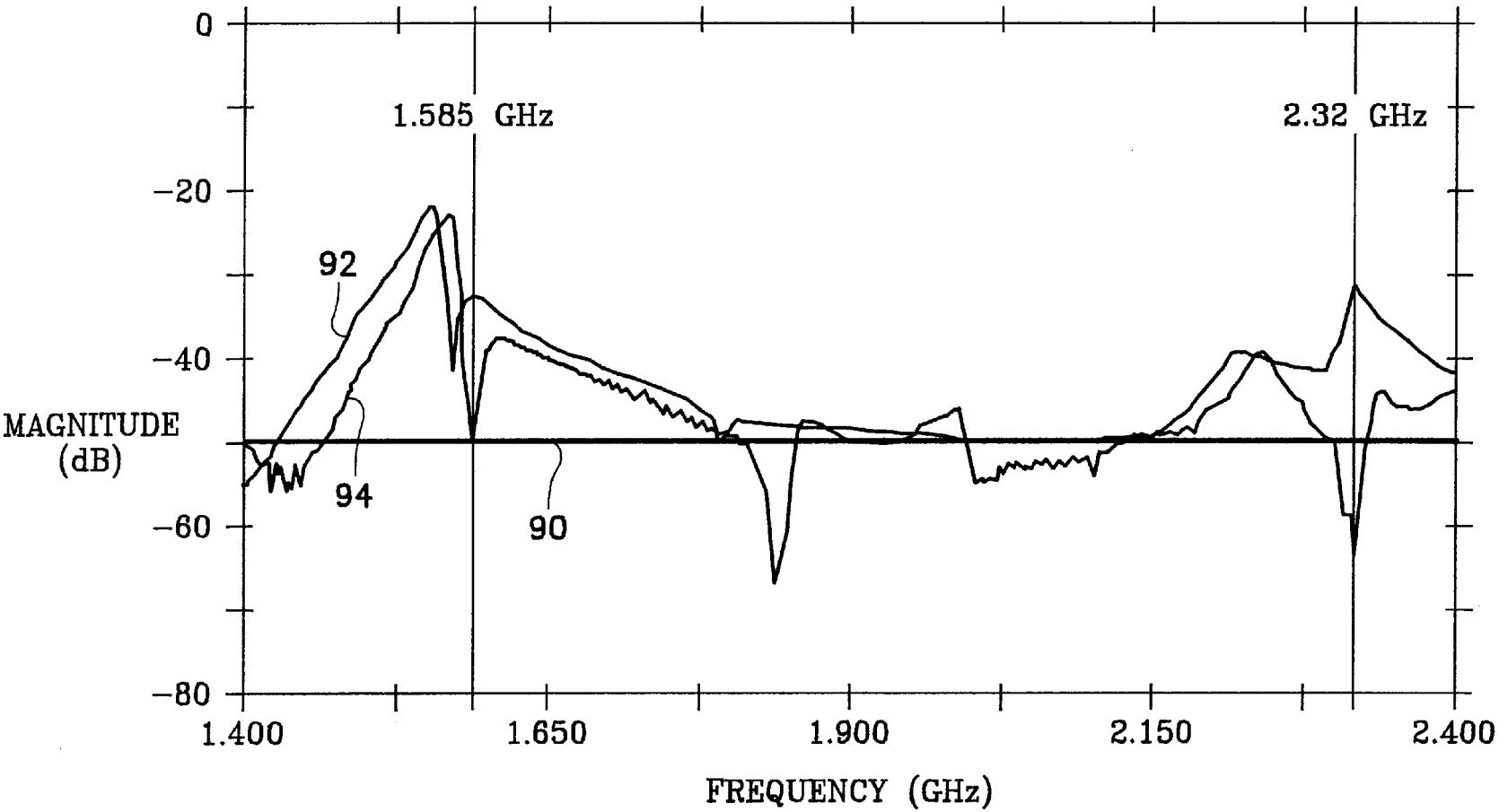
FIG. 2 illustrates the isolation between the telemetry antenna and the GPS antenna of FIG. 1.

Referring to FIG. 2, there is shown a pair of plots 92 and 94, with plot 92 being a computer simulated isolation and plot 94 being a measured isolation between the antennas 22 and 24. Plot 90 is the required isolation of −50.00 dB. The graph 94 illustrated in FIG. 2 shows that antennas 22 and 24 meet the required isolation.

Figure 3:
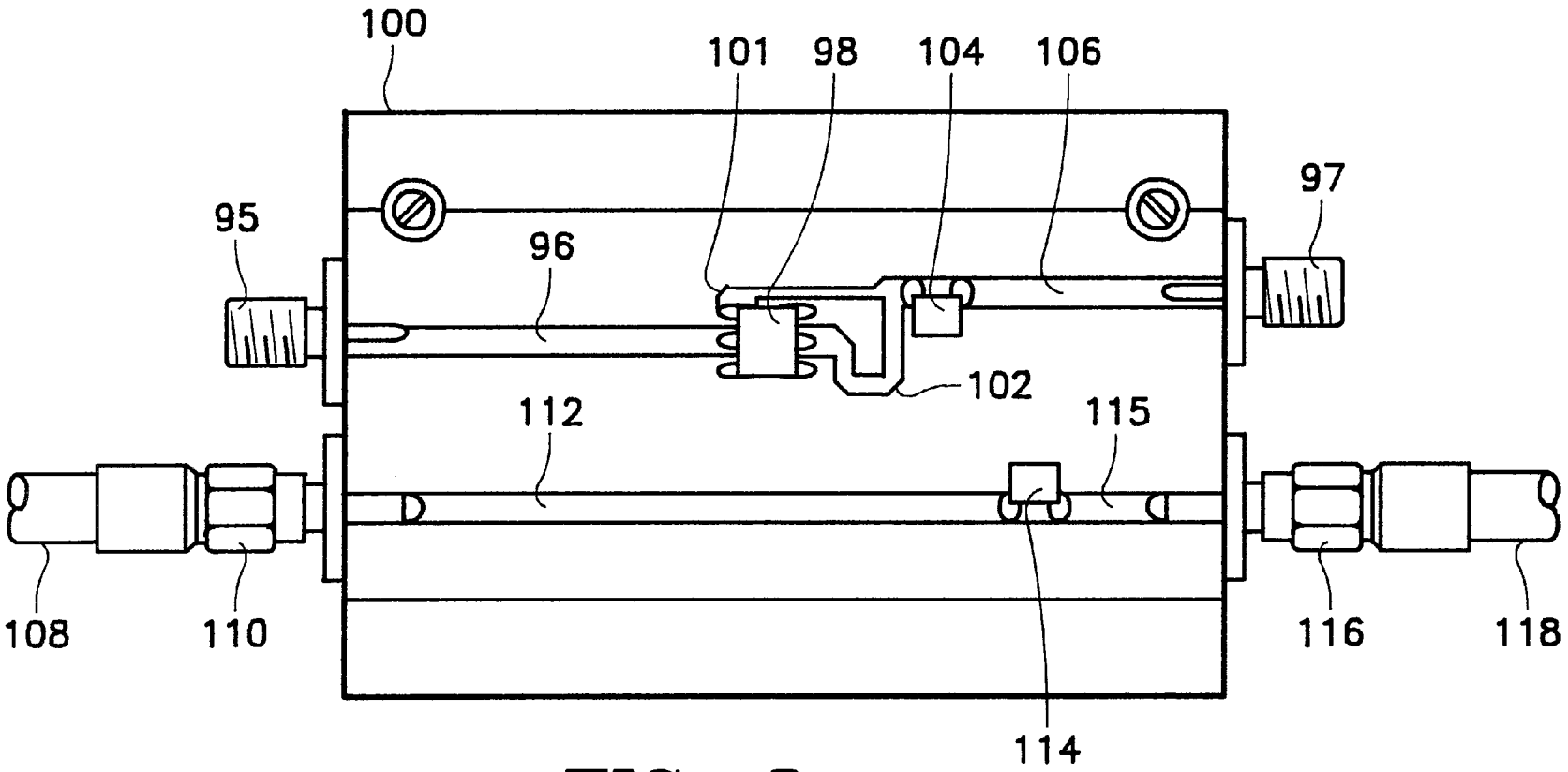
FIG. 3 is an electrical schematic diagram illustrating an amplifier and limiter connected to the microstrip antenna of FIG. 1.

Referring now to FIGS. 1 and 3, there is shown an electronics assembly 100 for testing the performance of an amplifier 98 and a limiter 104 electrically connected to the GPS antenna 24 of microstrip antenna 20. The signal from GPS antenna 24 is input to assembly 100 via a threaded input connector 97. Connecting threaded input connector 97 to limiter 104 is an etched copper line 106. Connecting limiter 104 to amplifier 98 are a pair of etched copper lines 101 and 102. Assembly 100 also includes an etched copper line 96 which connects amplifier 98 to a threaded output connector 95.

Assembly 100 has a input connector 116 which allows for an electrical cable 118 to be connected to a limiter 114 via an etched copper line 115. Assembly 100 also has an output connector 110 which is used to connect cable 108 to assembly 110. An etched copper line 112 connects limiter 114 to connector 110.

Amplifier 98 amplifies the signal received by GPS antenna 24, while limiter 104 is a protective device which prevents damage to amplifier 98 when electric field has sufficient strength to damage the amplifier.

Figure 4:
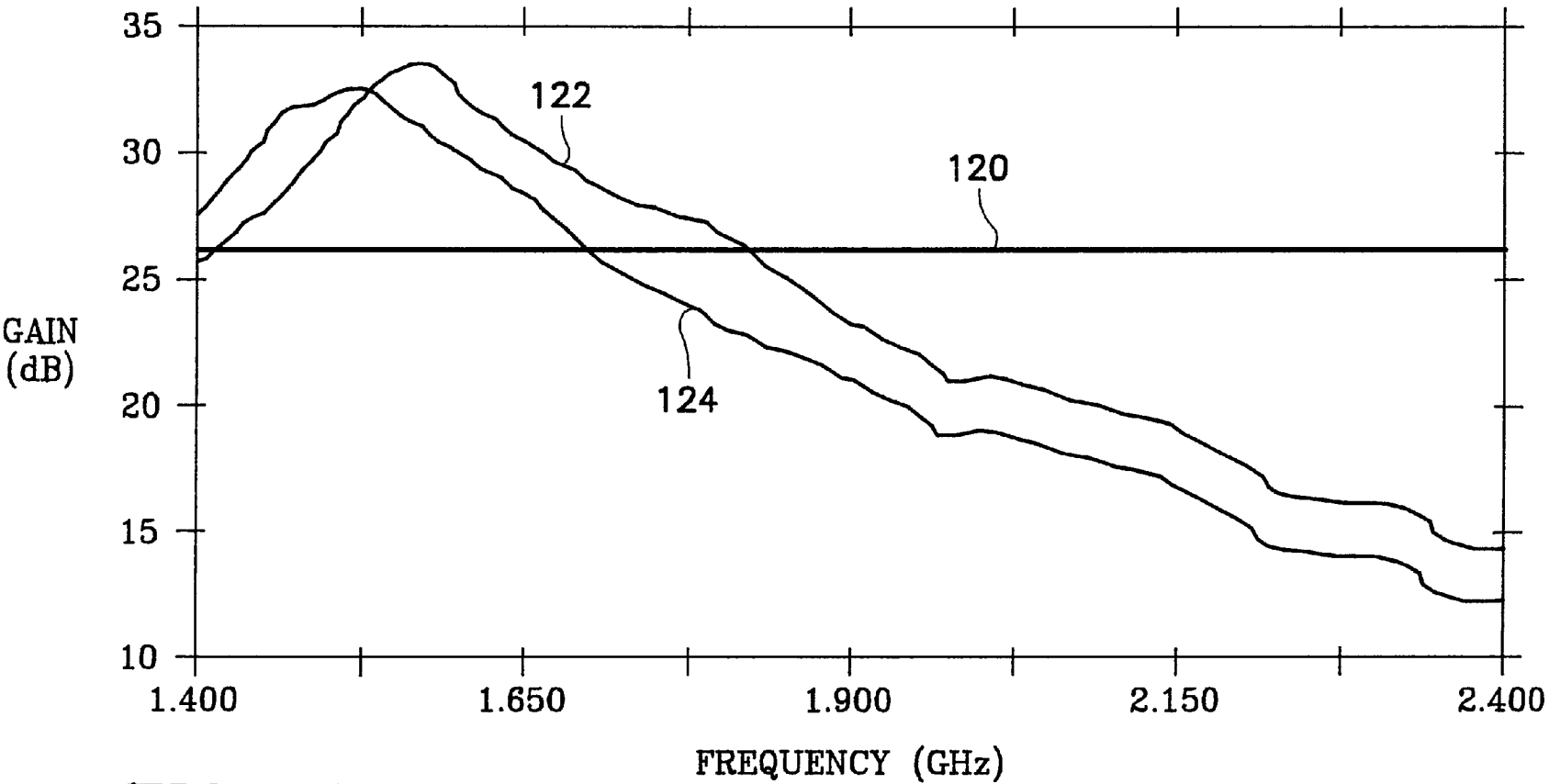
FIG. 4 illustrates gain versus frequency for the amplifier and limiter of FIG. 3.

Referring to FIGS. 1, 3 and 4, FIG. 4 illustrates the measured response of the limiter 104 and the amplifier 102 in combination at 3 and 5 volts bias. Plot 122 is 5 volts bias, while plot 124 is 3 volts bias and plot 120 is the specified minimum gain of 26 dB at 1.575 GHz. It should be noted that the amplifier matching circuitry contributes to an additional band pass filter response to further enhance the performance of microstrip antenna assembly 20. The measured noise was 0.9 dB at 3 volts and 1.1 dB at 5 volts.

Figure 5B:
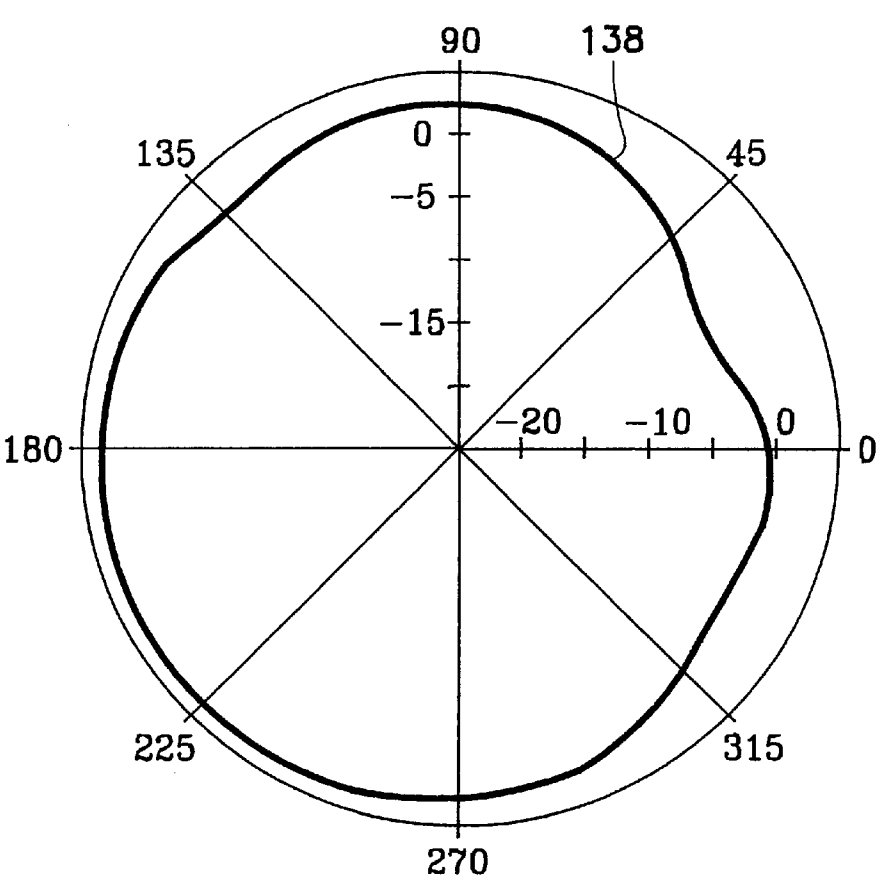
FIGS. 5 and 6 illustrate measured performance for the antenna elements of FIG. 1.
Figure 5A:
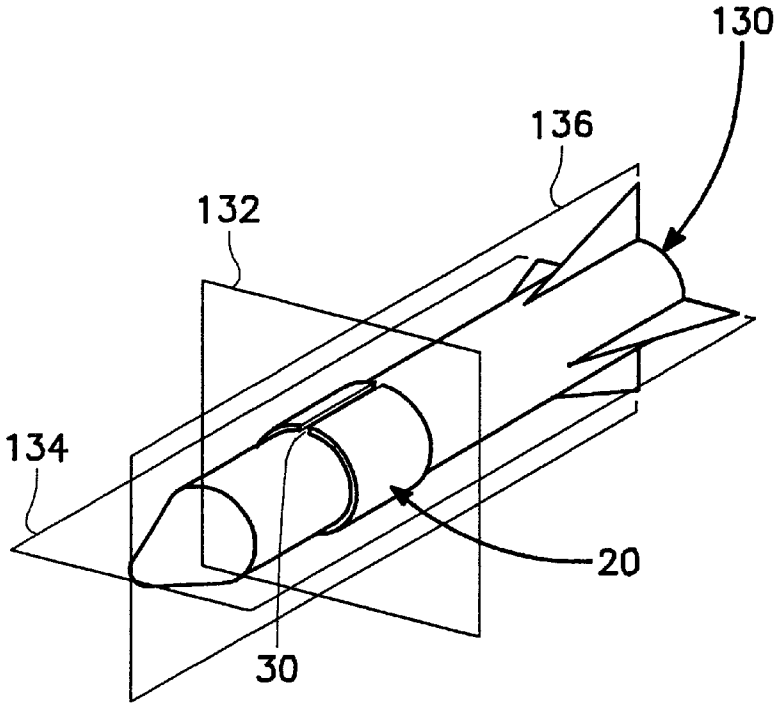
Figure 6B:
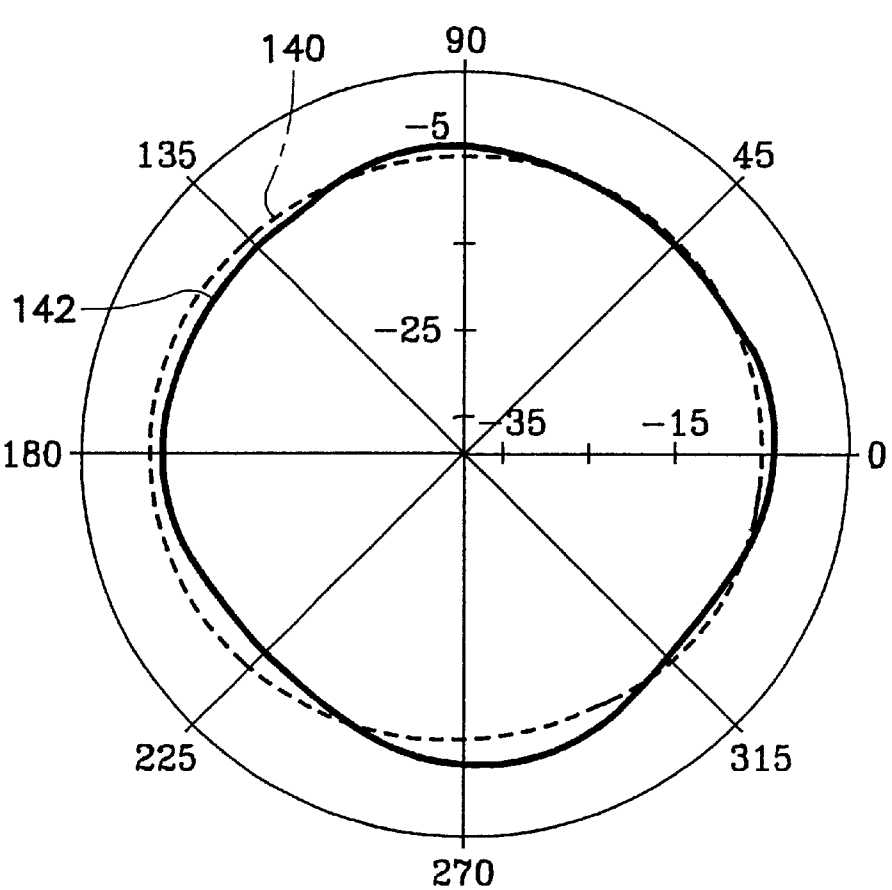
Figure 6A:
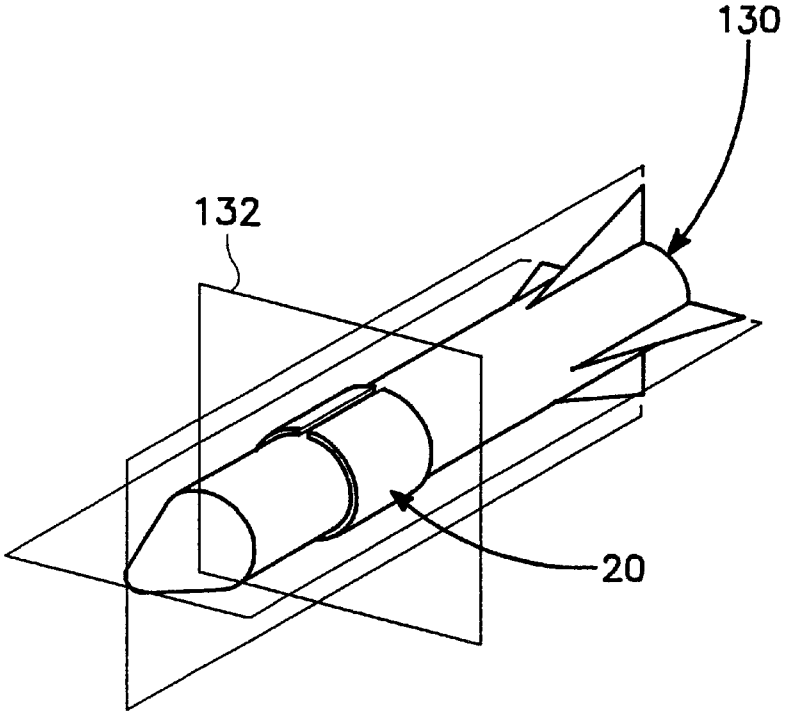

Referring now to FIGS. 1, 5 and 6, the plot 138 FIG. 5B is the measured performance of the telemetry antenna 22 in the roll plane 132 when mounted on missile 130 in the manner illustrated in FIG. 5A. It should be noted that microstrip antenna assembly 20 includes a seam 30 as shown in FIG. 5A. Measurements were also made in the yaw plane 134 and the pitch plane 136. The pitch, roll and yaw responses for the telemetry antenna 22 were found to be very acceptable.

The plots 140 and 142 of FIG. 6B are the vertical and horizontal polarization responses of the GPS (Global Positioning System) antenna 24 in the roll plane 132 when mounted on missile 130 in the manner illustrated in FIG. 5A. Polarization measurements were also made in the yaw plane and the telemetry plane. The pitch, roll and yaw responses for the GPS antenna 24 were also very acceptable.

At this time it should be noted that the antenna elements of antenna system 20 including telemetry antenna 22 and a GPS (Global Positioning System) antenna 24 as well as band stop filters 43 and 82 are fabricated from etched copper.

From the foregoing, it is readily apparent that the present invention comprises a new, unique, and exceedingly microstrip antenna for use on a small diameter projectile, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A microstrip antenna system for use on a small diameter projectile comprising:

a dielectric substrate wrapped around an outer circumference of said small diameter projectile;

a microstrip telemetry antenna mounted on said dielectric substrate, said microstrip telemetry antenna transmitting a first RF signal;

a microstrip GPS (Global Positioning System) antenna mounted on said dielectric substrate in proximity to said microstrip telemetry antenna, said microstrip GPS antenna receiving a second RF signal;

a first band stop filter integrally formed with said microstrip GPS antenna on said dielectric substrate;

a second band stop filter integrally formed with said microstrip telemetry antenna on said dielectric substrate; and said first band stop filter and said second band stop filter providing for a minimum stop-band rejection of approximately 50 decibels to isolate the first RF signal transmitted by said microstrip telemetry antenna from the second RF signal received by said microstrip GPS antenna.

2. The microstrip antenna system of claim 1 wherein said first RF signal is an S-Band Radio Frequency signal.

3. The microstrip antenna system of claim 2 wherein said first RF signal has a linear polarization.

4. The microstrip antenna system of claim 1 wherein said second RF signal is an L-Band Radio Frequency signal.

5. The microstrip antenna system of claim 4 wherein said second RF signal has a circular polarization.

6. The microstrip antenna system of claim 1 wherein said microstrip telemetry antenna comprises:

a feed input point;

a first antenna transmitting element positioned on one side of said projectile, said first antenna transmitting element having a rectangular shape and a notch feed point;

a second antenna transmitting element positioned on an opposite side of said projectile, said second antenna transmitting element having a rectangular shape and a notch feed point;

said first antenna transmitting element and second antenna transmitting element each having a pair of elongated slots;

a first feed line having one end connected to the notch feed point of said first antenna transmitting element and an opposite end connected to said feed input point;

a second feed line having one end connected to the notch feed point of said second antenna transmitting element and an opposite end connected to said feed input point;

said first feed line and said second feed line having lengths which are sufficiently different to provide for a 180 degree phase shift of said first RF signal when transmitted by said first and second antenna transmitting elements, the 180 degree phase shift of said first RF signal insuring that an electric field for said first RF signal is continuous around the outer circumference of said projectile.

7. The microstrip antenna system of claim 6 wherein said microstrip telemetry antenna includes first and second open circuit transmission lines connected to said feed input point to form said second band stop filter.

8. The microstrip antenna system of claim 1 wherein said microstrip GPS antenna comprises:

a fifty ohm feed input;

a first antenna receiving element positioned on one side of said projectile, said first antenna receiving element having a rectangular shape which approximates a square, a centrally located aperture, and a feed point;

a second antenna receiving element positioned on an opposite side of said projectile, said second antenna receiving element having a rectangular shape which approximates a square, a centrally located aperture and a feed point;

a first feed line having one end connected to the feed point of said first antenna receiving element and an opposite end;

a second feed line having one end connected to the feed point of said second antenna receiving element and an opposite end; and a power divider connected to said fifty ohm feed input, said power divider being connected to the opposite end of said first feed line, and the opposite end of said second feed line.

9. The microstrip antenna system of claim 8 wherein said power divider includes a pair of open circuit transmission lines to form said first band stop filter.

10. The microstrip antenna system of claim 1 wherein said microstrip telemetry antenna, said microstrip GPS antenna, said first band stop filter and said second band stop filter are fabricated from etched copper.

11. A microstrip antenna system for use on a small diameter projectile comprising:

a dielectric substrate wrapped around an outer circumference of said small diameter projectile;

a microstrip telemetry antenna mounted on a ground plane by said dielectric substrate, said microstrip telemetry antenna transmitting an S-Band Radio Frequency signal having a linear polarization;

a microstrip GPS (Global Positioning System) antenna mounted on said dielectric substrate in proximity to said microstrip telemetry antenna, said microstrip GPS antenna spaced apart from and electrically separated from said ground plane by said dielectric substrate, said microstrip GPS antenna receiving an L-Band Radio Frequency signal having a circular polarization; and a first band stop filter integrally formed with said microstrip GPS antenna on said dielectric substrate;

a second band stop filter integrally formed with said microstrip telemetry antenna on said dielectric substrate;

said first band stop filter and second band stop filter providing for a minimum stop-band rejection of approximately 50 decibels to isolate the S-Band Radio Frequency signal transmitted by said microstrip telemetry antenna from the L-Band Radio Frequency signal received by said microstrip GPS antenna.

12. The microstrip antenna system of claim 11 wherein said microstrip telemetry antenna comprises:

a feed input point;

a first antenna transmitting element positioned on one side of said projectile, said first antenna transmitting element having a rectangular shape and a notch feed point;

a second antenna transmitting element positioned on an opposite side of said projectile, said second antenna transmitting element having a rectangular shape and a notch feed point;

said first antenna transmitting element and second antenna transmitting element each having a pair of elongated slots;

a first feed line having one end connected to the notch feed point of said first antenna transmitting element and an opposite end connected to said feed input point;

a second feed line having one end connected to the notch feed point of said second antenna transmitting element and an opposite end connected to said feed input point;

said first feed line and said second feed line having lengths which are sufficiently different to provide for a 180 degree phase shift of said S-Band RF signal when transmitted by said first and second antenna transmitting elements, the 180 degree phase shift of said S-Band RF signal insuring that an electric field for said S-Band RF signal is continuous around the outer circumference of said projectile.

13. The microstrip antenna system of claim 12 wherein said microstrip telemetry antenna includes first and second open circuit transmission lines connected to said feed input point to form said second band stop filter.

14. The microstrip antenna system of claim 11 wherein said microstrip GPS antenna comprises:

a fifty ohm feed input;

a first antenna receiving element positioned on one side of said projectile, said first antenna receiving element having a rectangular shape which approximates a square, a centrally located aperture, and a feed point;

a second antenna receiving element positioned on an opposite side of said projectile, said second antenna receiving element having a rectangular shape which approximates a square, a centrally located aperture and a feed point;

a first feed line having one end connected to the feed point of said first antenna receiving element and an opposite end;

a second feed line having one end connected to the feed point of said second antenna receiving element and an opposite end; and a power divider connected to said fifty ohm feed input, said power divider being connected to the opposite end of said first feed line, and the opposite end of said second feed line.

15. The microstrip antenna system of claim 14 wherein said power divider includes a pair of open circuit transmission lines to form said first band stop filter.

16. The microstrip antenna system of claim 11 wherein said microstrip telemetry antenna, said microstrip GPS antenna, said first band stop filter and said second band stop filter are fabricated from etched copper.

17. A microstrip antenna system for use on a small diameter projectile comprising:

a dielectric substrate wrapped around an outer circumference of said small diameter projectile;

a microstrip telemetry antenna mounted on a ground plane by said dielectric substrate, said microstrip telemetry antenna transmitting an S-Band Radio Frequency signal having a linear polarization;

a microstrip GPS (Global Positioning System) antenna mounted on said dielectric substrate in proximity to said microstrip telemetry antenna, said microstrip GPS antenna spaced apart from and electrically separated from said ground plane by said dielectric substrate, said microstrip GPS antenna receiving an L-Band Radio Frequency signal having a circular polarization; and a first band stop filter integrally formed with said microstrip GPS antenna on said dielectric substrate;

a second band stop filter integrally formed with said microstrip telemetry antenna on said dielectric substrate;

said first band stop filter and second band stop filter providing for a minimum stop-band rejection of approximately 50 decibels to isolate the S-Band Radio Frequency signal transmitted by said microstrip telemetry antenna from the L-Band Radio Frequency signal received by said microstrip GPS antenna;

a limiter electrically connected to said GPS antenna;

an amplifier electrically connected to said limiter, said amplifier amplifying an electrical signal provided by said GPS antenna; and said limiter operating as a protective device to prevent damage to said amplifier.

18. The microstrip antenna system of claim 17 wherein said microstrip telemetry antenna comprises:

a feed input point;

a first antenna transmitting element positioned on one side of said projectile, said first antenna transmitting element having a rectangular shape and a notch feed point;

a second antenna transmitting element positioned on an opposite side of said projectile, said second antenna transmitting element having a rectangular shape and a notch feed point;

said first antenna transmitting element and second antenna transmitting element each having a pair of elongated slots;

a first feed line having one end connected to the notch feed point of said first antenna transmitting element and an opposite end connected to said feed input point;

a second feed line having one end connected to the notch feed point of said second antenna transmitting element and an opposite end connected to said feed input point;

said first feed line and said second feed line having lengths which are sufficiently different to provide for a 180 degree phase shift of said S-Band RF signal when transmitted by said first and second antenna transmitting elements, the 180 degree phase shift of said S-Band RF signal insuring that an electric field for said S-Band RF signal is continuous around the outer circumference of said projectile; and said microstrip telemetry antenna including first and second open circuit transmission lines connected to said feed input point to form said second band stop filter.

19. The microstrip antenna system of claim 17 wherein said microstrip GPS antenna comprises:

a fifty ohm feed input;

a first antenna receiving element positioned on one side of said projectile, said first antenna receiving element having a rectangular shape which approximates a square, a centrally located aperture, and a feed point;

a second antenna receiving element positioned on an opposite side of said projectile, said second antenna receiving element having a rectangular shape which approximates a square, a centrally located aperture and a feed point;

a first feed line having one end connected to the feed point of said first antenna receiving element and an opposite end;

a second feed line having one end connected to the feed point of said second antenna receiving element and an opposite end; and a power divider connected to said fifty ohm feed input, said power divider being connected to the opposite end of said first feed line, and the opposite end of said second feed line; and said power divider including a pair of open circuit transmission lines to form said first band stop filter.

20. The microstrip antenna system of claim 17 wherein said microstrip telemetry antenna, said microstrip GPS antenna, said first band stop filter and said second band stop filter are fabricated from etched copper.

* * * * *